US005114452A

United States Patent [19]

Dray

[11] Patent Number: 5,114,452

[45] Date of Patent: May 19, 1992

[54] CRYOGENIC AIR SEPARATION SYSTEM FOR PRODUCING ELEVATED PRESSURE PRODUCT GAS

[75] Inventor: James R. Dray, Kenmore, N.Y.

[73] Assignee: Union Carbide Industrial Gases Technology Corporation, Danbury, Conn.

[21] Appl. No.: 544,372

[22] Filed: Jun. 27, 1990

[51] Int. Cl.[5] ..... F25J 3/02

[52] U.S. Cl. ..... 62/24; 62/38; 62/43

[58] Field of Search ..... 62/11, 22, 24, 38, 43

[56] References Cited

U.S. PATENT DOCUMENTS

| | | | |
|---|---|---|---|
| 2,712,738 | 7/1955 | Wucherer et al. | 62/175.5 |
| 2,915,882 | 12/1959 | Schuftan et al. | 62/30 |
| 3,059,440 | 10/1962 | Loporto | 62/11 |
| 3,102,801 | 9/1963 | Fetterman | 62/31 |
| 3,214,925 | 11/1965 | Becker | 62/13 |
| 3,269,130 | 8/1966 | Cost et al. | 62/30 |
| 3,280,574 | 10/1966 | Becker | 62/13 |
| 3,754,406 | 8/1973 | Allam | 62/41 |
| 3,905,201 | 9/1975 | Coveney et al. | 62/13 |
| 4,299,607 | 11/1981 | Okabe et al. | 62/13 |
| 4,345,925 | 8/1982 | Cheung | 62/13 |
| 4,560,398 | 12/1985 | Beddome et al. | 62/29 |
| 4,662,917 | 5/1987 | Cormier, Jr. et al. | 62/43 |
| 4,705,548 | 11/1987 | Agrawal et al. | 62/38 |
| 4,836,836 | 6/1989 | Bennett et al. | 62/22 |
| 4,895,583 | 1/1990 | Flanagan et al. | 62/24 |

*Primary Examiner*—Ronald C. Gapossela
*Attorney, Agent, or Firm*—Stanley Ktorides

[57] ABSTRACT

A cryogenic air separation system wherein one portion of the feed air is turboexpanded to generate refrigeration, a second portion is condensed against vaporizing product from the air separation plant, and both portions are fed into the same column to undergo separation.

18 Claims, 2 Drawing Sheets

CRYOGENIC AIR SEPARATION SYSTEM FOR PRODUCING ELEVATED PRESSURE PRODUCT GAS

TECHNICAL FIELD

This invention relates generally to cryogenic air separation and more particularly to the production of elevated pressure product gas from the air separation.

BACKGROUND ART

An often used commercial system for the separation of air is cryogenic rectification. The separation is driven by elevated feed pressure which is generally attained by compressing feed air in a compressor prior to introduction into a column system. The separation is carried out by passing liquid and vapor in countercurrent contact through the column or columns on vapor liquid contacting elements whereby more volatile component(s) are passed from the liquid to the vapor, and less volatile component(s) are passed from the vapor to the liquid. As the vapor progresses up a column it becomes progressively richer in the more volatile components and as the liquid progresses down a column it becomes progressively richer in the less volatile components. Generally the cryogenic separation is carried out in a main column system comprising at least one column wherein the feed is separated into nitrogen-rich and oxygen-rich components, and in an auxiliary argon column wherein feed from the main column system is separated into argon-richer and oxygen-richer components.

Often it is desired to recover product gas from the air separation system at an elevated pressure. Generally this is carried out by compressing the product gas to a higher pressure by passage through a compressor. Such a system is effective but is quite costly.

Accordingly it is an object of this invention to provide an improved cryogenic air separation system.

It is another object of this invention to provide a cryogenic air separation system for producing elevated pressure product gas while reducing or eliminating the need for product gas compression.

It is a further object of this invention to provide a cryogenic air separation system which exhibits improved argon recovery.

SUMMARY OF THE INVENTION

The above and other objects which will become apparent to one skilled in the art upon a reading of this disclosure are attained by the present invention which comprises in general the turboexpansion of one portion of compressed feed air to provide plant refrigeration and to enhance argon recovery, and the condensation of another portion of the feed air against a vaporizing liquid to produce product gas.

More specifically one aspect of the present invention comprises:

Method for the separation of air by cryogenic distillation to produce product gas comprising:

(A) turboexpanding a first portion of cooled, compressed feed air and introducing the resulting turboexpanded portion into a first column of an air separation plant, said first column operating at a pressure generally within the range of from 60 to 100 psia;

(B) condensing at least part of a second portion of the cooled, compressed feed air and introducing resulting liquid into said first column;

(C) separating the fluids passed into said first column into nitrogen-enriched and oxygen-enriched fluids and passing said fluids into a second column of said air separation plant, said second column operating at a pressure less than that of said first column;

(D) separating the fluids passed into the second column into nitrogen-rich vapor and oxygen-rich liquid;

(E) vaporizing oxygen-rich liquid by indirect heat exchange with the second portion of the cooled, compressed feed air to carry out the condensation of step (B);

(F) recovering vapor resulting from the heat exchange of step (E) as product oxygen gas; and (G) passing argon-containing fluid from the second column into an argon column, separating the argon-containing fluid into oxygen-richer liquid and argon-richer vapor, and recovering at least some argon-richer fluid.

Another aspect of the present invention comprises:

Apparatus for the separation of air by cryogenic distillation to produce product gas comprising:

(A) an air separation plant comprising a first column, a second column, a reboiler, means to pass fluid from the first column to the reboiler and means to pass fluid from the reboiler to the second column;

(B) a turboexpander, means to provide feed air to the turboexpander and means to pass fluid from the turboexpander into the first column;

(C) a condenser, means to provide feed air to the condenser and means to pass fluid from the condenser into the first column;

(D) means to pass fluid from the air separation plant to the condenser;

(E) means to recover product gas from the condenser; and (F) an argon column, means to pass fluid from the second column to the argon column, and means to recover fluid from the argon column.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith, et al., page 13-3 *The Continuous Distillation Process.* The term, double column is used herein to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

As used herein, the term "argon column" means a column wherein upflowing vapor becomes progressively enriched in argon by countercurrent flow against descending liquid and an argon product is withdrawn from the column.

The term "indirect heat exchange", as used herein means the bringing of two fluid streams into heat exchange relation without any physical contact or intermixing of the fluids with each other.

As used herein, the term "vapor-liquid contacting elements" means any devices used as column internals to facilitate mass transfer, or component separation, at the liquid vapor interface during countercurrent flow of the two phases.

As used herein, the term "tray" means a substantially flat plate with openings and liquid inlet and outlet so that liquid can flow across the plate as vapor rises through the openings to allow mass transfer between the two phases.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "random packing" means packing wherein individual members do not have any particular orientation relative to each other or to the column axis.

As used herein, the term "structured packing" means packing wherein individual members have specific orientation relative to each other and to the column axis.

As used herein the term "theoretical stage" means the ideal contact between upwardly flowing vapor and downwardly flowing liquid into a stage so that the exiting flows are in equilibrium.

As used herein the term "turboexpansion" means the flow of high pressure gas through a turbine to reduce the pressure and temperature of the gas and thereby produce refrigeration. A loading device such as a generator, dynamometer or compressor is typically used to recover the energy.

As used herein the term "condenser" means a heat exchanger used to condense a vapor by indirect heat exchange.

As used herein the term "reboiler" means a heat exchanger used to vaporize a liquid by indirect heat exchange. Reboilers are typically used at the bottom of distillation columns to provide vapor flow to the vapor-liquid contacting elements.

As used herein the term "air separation plant" means a facility wherein air is separated by cryogenic rectification, comprising at least one column and attendant interconnecting equipment such as pumps, piping, valves and heat exchangers.

DETAILED DESCRIPTION

The invention will be described in detail with reference to the Drawings.

Figure 1:
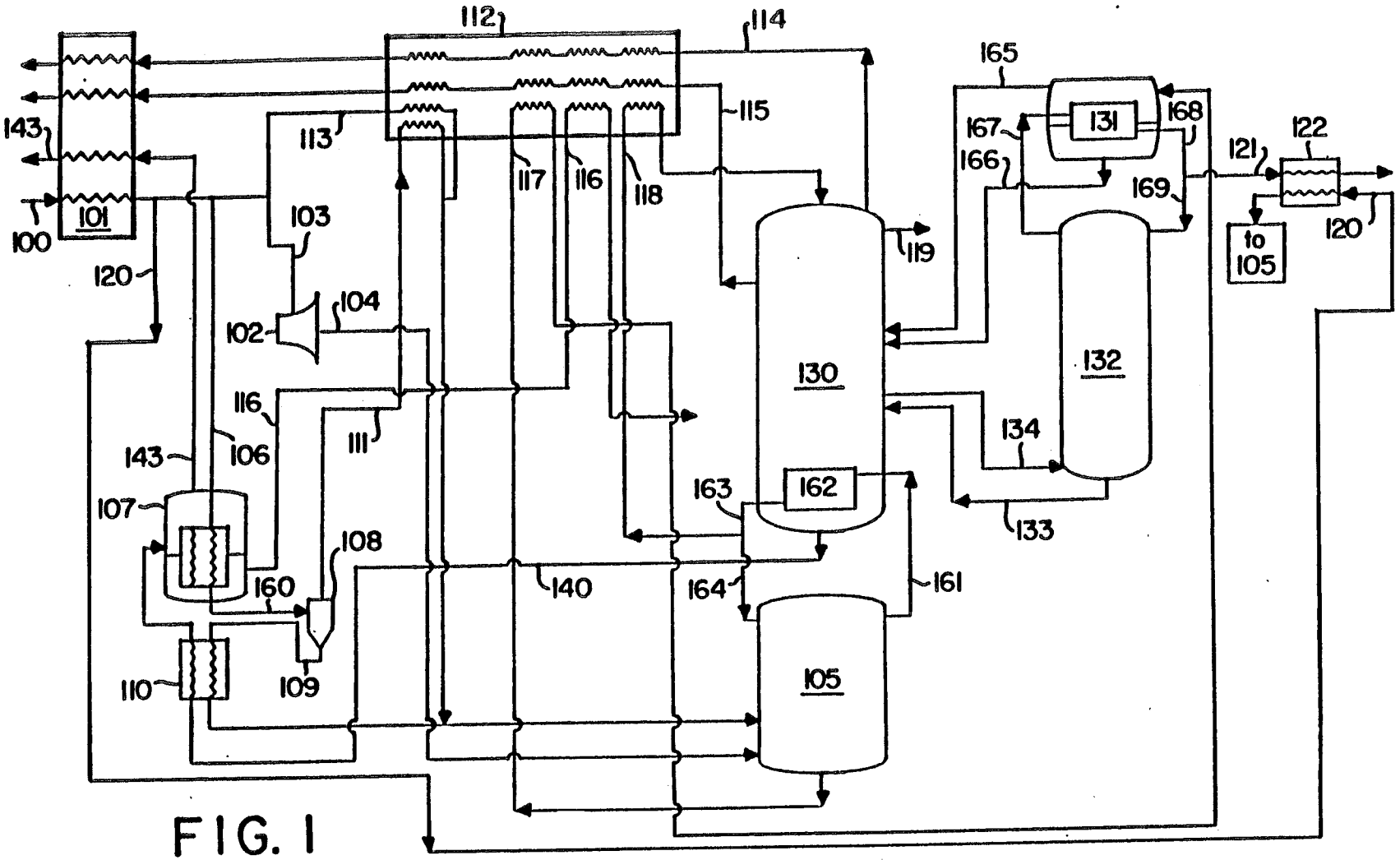
FIG. 1 is a simplified schematic flow diagram of one preferred embodiment of the cryogenic air separation system of this invention

Referring now to FIG. 1 feed air 100 which has been compressed to a pressure generally within the range of from 90 to 500 pounds per square inch absolute (psia) is cooled by indirect heat exchange against return streams by passage through heat exchanger 101. A first portion 103 of the cooled, compressed feed air is provided to turboexpander 102 and turboexpanded to a pressure generally within the range of from 60 to 100 psia. The resulting turbo-expanded air 104 is introduced into first column 105 which is operating at a pressure generally within the range of from 60 to 100 psia. Generally portion 103 will comprise from 70 to 90 percent of feed air 100.

A second portion 106 of the cooled, compressed feed air is provided to condenser 107 wherein it is at least partially condensed by indirect heat exchange with vaporizing oxygen-rich liquid taken from the air separation plant as will be more fully discussed later. Generally second portion 106 comprises from 5 to 30 percent of feed air 100. Resulting liquid is introduced into column 105 at a point above the vapor feed. In the case where stream 106 is only partially condensed, resulting stream 160 may be passed directly into column 105 or may be passed, as shown in FIG. 1, to separator 108. Liquid 109 from separator 108 is then passed into column 105. Liquid 109 may be further cooled by passage through heat exchanger 110 prior to being passed into column 105. Cooling the condensed portion of the feed air improves liquid production from the process.

Vapor 111 from separator 108 may be passed directly into column 105 or may be cooled or condensed in heat exchanger 112 against return streams and then passed into column 105. Furthermore, a fourth portion 113 of the cooled compressed feed air may be cooled or condensed in heat exchanger 112 against return streams and then passed into column 105. Streams 111 and 113 can be utilized to adjust the temperature of the feed air fraction 103 that is turboexpanded. For example, increasing stream 113 will increase warming of the return streams in heat exchanger 112 and thereby the temperature of stream 103 will be increased. The higher inlet temperature to turboexpander 102 can increase the developed refrigeration and can control the exhaust temperature of the expanded air to avoid any liquid content. A third portion 120 of the cooled compressed feed air may be further cooled or condensed by indirect heat exchange, such as in heat exchanger 122, with fluid produced in the argon column and then passed into column 105.

Within first column 105 the feeds are separated by cryogenic distillation into nitrogen-enriched and oxygen-enriched fluids. In the embodiment illustrated in FIG. 1 the first column is the higher pressure column a double column system. Nitrogen-enriched vapor 161 is withdrawn from column 105 and condensed in reboiler 162 against boiling column 130 bottoms. Resulting liquid 163 is divided into stream 164 which is returned to column 105 as liquid reflux, and into stream 118 which is subcooled in heat exchanger 112 and flashed into second column 130 of the air separation plant. Second column 130 is operating at a pressure less than that of first column 105 and generally within the range of from 15 to 30 psia. Liquid nitrogen product may be recovered from stream 118 before it is flashed into column 130 or, as illustrated in FIG. 1, may be taken directly out of column 130 as stream 119 to minimize tank flash-off.

Oxygen-enriched liquid is withdrawn from column 105 as stream 117, subcooled in heat exchanger 112 and passed into column 130. All or part of stream 117 may be flashed into condenser 131 which serves to condense argon column top vapor. Resulting streams 165 and 166 comprising vapor and liquid respectively are then passed from condenser 131 into column 130.

Within column 130 the fluids passed into the column are separated by cryogenic distillation into nitrogen-rich vapor and oxygen-rich liquid. Nitrogen-rich vapor is withdrawn from column 130 as stream 114, warmed by passage through heat exchangers 112 and 101 to about ambient temperature and recovered as product nitrogen gas. Nitrogen-rich waste stream 115 is withdrawn from column 130 at a point between the nitrogen-enriched and oxygen-enriched feed stream introduction points, and is warmed by passage through heat exchangers 112 and 101 before being released to the atmosphere. Some portion of waste stream 115 can be utilized to regenerate adsorption beds used to clean the feed air. Nitrogen recoveries of up to 90 percent or more are possible by use of this invention.

A stream comprising primarily oxygen and argon is passed 134 from column 130 into argon column 132 wherein it is separated by cryogenic distillation into oxygen-richer liquid and argon-richer vapor. Oxygen-richer liquid is returned as stream 133 to column 130. Argon-richer vapor is passed 167 to argon column condenser 131 and condensed against oxygen-enriched fluid to produce argon-richer liquid 168. A portion 169 of argon-richer liquid is employed as liquid reflux for column 132. Another portion 121 of the argon-richer liquid is recovered as crude argon product generally having an argon concentration exceeding 96 percent. As illustrated in FIG. 1, crude argon product stream 121 may be warmed or vaporized in heat exchanger 122 against feed air stream 120 prior to further upgrading and recovery.

The invention is particularly advantageous in obtaining good argon recovery because refrigeration is produced by expanding a portion of the feed air before it enters the high pressure column. This maximizes the liquid feeds to the low pressure column and improves the reflux ratios in that column. Other systems which expand vapor from the high pressure column or air into the low pressure column would have less liquid feed to the low pressure column.

Oxygen-rich liquid 140 is withdrawn from column 130 and pressurized to a pressure greater than that of column 130 by either a change in elevation, i.e. the creation of liquid head as illustrated in FIG. 1, by pumping, by employing a pressurized storage tank, or by any combination of these methods. The liquid is then warmed by passage through heat exchanger 110 and passed into condenser or product boiler 107 where it is at least partially vaporized. Gaseous product oxygen 143 is passed from condenser 107, warmed through heat exchanger 101 and recovered as product oxygen gas. As used herein the term "recovered" means any treatment of the gas or liquid including venting to the atmosphere. Liquid 116 may be taken from condenser 107, subcooled by passage through heat exchanger 112 and recovered as product liquid oxygen. Generally the oxygen product will have a purity within the range of from 99.0 to 99.95 percent. Oxygen recoveries of up to 99.9 percent are attainable with the invention.

The oxygen content of the liquid from the bottom of column 105 is lower than in a conventional process which does not utilize an air condenser. This changes the reflux ratios in the bottom of column 105 and all sections of column 130 when compared to a conventional process. High product recoveries are possible with the invention since refrigeration is produced without requiring vapor withdrawal from column 105 or an additional vapor feed to column 130. Producing refrigeration by adding vapor air from a turbine to column 130 or removing vapor nitrogen from column 105 to feed a turbine would reduce the reflux ratios in column 130 and significantly reduce product recoveries. The invention is able to easily maintain high reflux ratios, and hence high product recoveries.

Additional flexibility could be gained by splitting the feed air before it enters heat exchanger 101. The air could be supplied at two different pressures if the liquid production requirements do not match the product pressure requirements. Increasing product pressure will raise the air pressure required at the product boiler, while increased liquid requirements will increase the air pressure required at the turbine inlet.

Figure 2:
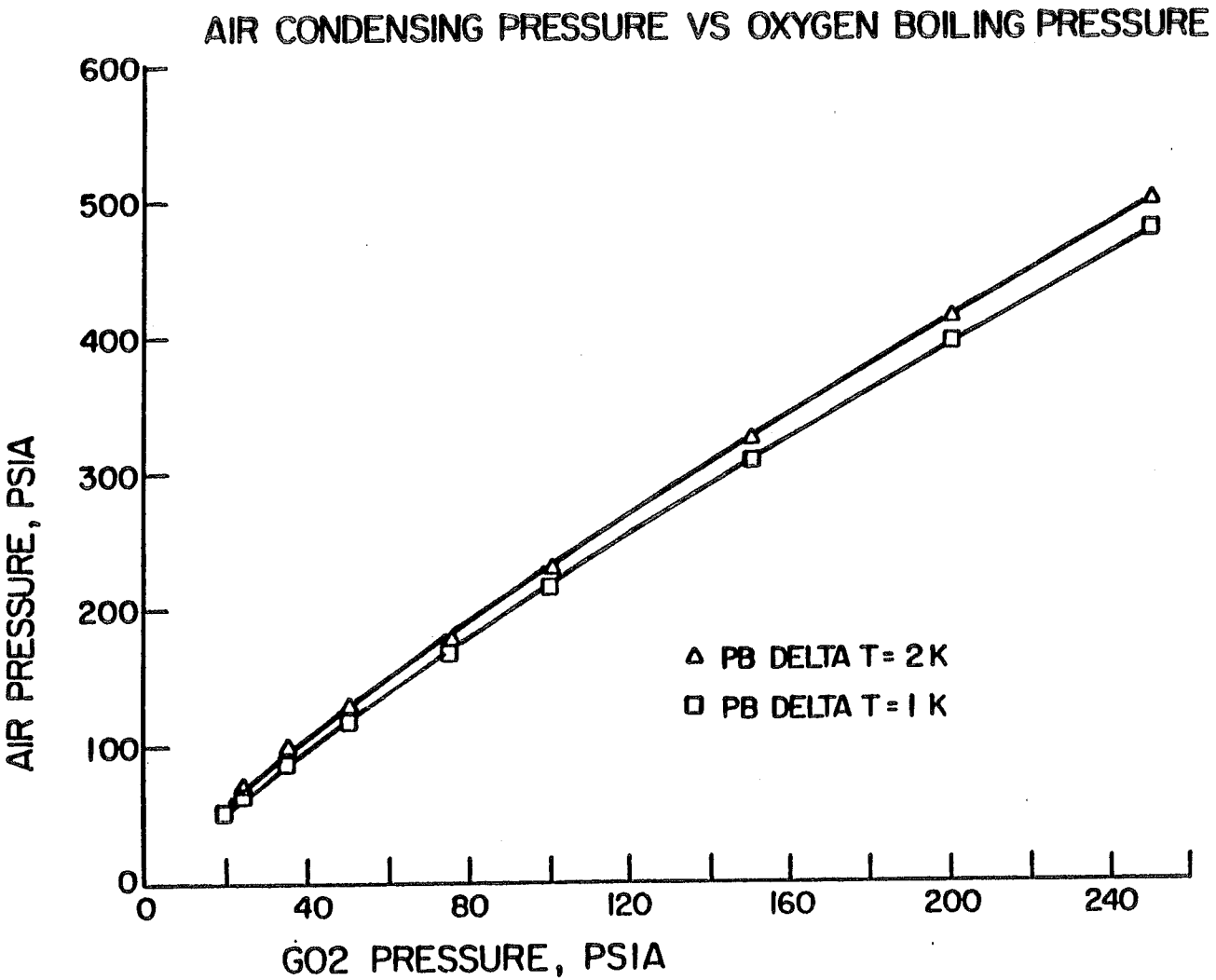
FIG. 2 is a graphical representation of air condensing pressure against oxygen boiling pressure.

FIG. 2 illustrates the air condensing pressure required to produce oxygen gas product over a range of pressures for product boiling delta T's of 1 and 2 degrees K. There will be a finite temperature difference (delta T) between streams in any indirect heat exchanger. Increasing heat exchanger surface area and/or heat transfer coefficients will reduce the temperature difference (delta T) between the streams. For a fixed oxygen pressure requirement, decreasing the delta T will allow the air pressure to be reduced, decreasing the energy required to compress the air and reducing operating costs.

Net liquid production will be affected by many parameters. Turbine flows, pressures, inlet temperatures, and efficiencies will have significant impact since they determine the refrigeration production. Air inlet pressure, temperature, and warm end delta T will set the warm end losses. The total liquid production (expressed as a fraction of the air) is dependent on the air pressures in and out of the turbines, turbine inlet temperatures, turbine efficiencies, primary heat exchanger inlet temperature and amount of product produced as high pressure gas. The gas produced as high pressure product requires power input to the air compressor to replace product compressor power.

Recently packing has come into increasing use as vapor-liquid contacting elements in cryogenic distillation in place of trays. Structured or random packing has the advantage that stages can be added to a column without significantly increasing the operating pressure of the column. This helps to maximize product recoveries, increases liquid production, and increases product purities. Structured packing is preferred over random packing because its performance is more predictable. The present invention is well suited to the use of structured packing. In particular, structured packing may be particularly advantageously employed as some or all of the vapor-liquid contacting elements in the second or lower pressure column and in the argon column.

The high product delivery pressure attainable with this invention will reduce or eliminate product compression costs. In addition, if some liquid production is required, it can be produced by this invention with relatively small capital costs. The primary heat exchangers will be shorter and fewer will be required than in a conventional system using air expansion to the lower pressure column. This is due to the large driving force for heat transfer.

Although the invention has been described in detail with reference to a certain embodiment, those skilled in the art will recognize that there are other embodiments within the spirit and scope of the claims.

I claim:

1. Method for the separation of air by cryogenic distillation to produce product gas comprising:

(A) turboexpanding a first portion of cooled, compressed feed air and introducing the resulting turboexpanded portion into a first column of an air separation plant, said first column operating at a pressure generally within the range of from 60 to 100 psia;

(B) condensing at least part of a second portion of the cooled, compressed feed air and introducing resulting liquid into said first column;

(C) separating the fluids passed into said first column into nitrogen-enriched and oxygen-enriched fluids and passing said fluids into a second column of said air separation plant, said second column operating at a pressure less than that of said first column;

(D) separating the fluids passed into the second column into nitrogen-rich vapor and oxygen-rich liquid;

(E) vaporizing oxygen-rich liquid by indirect heat exchange with the second portion of the cooled, compressed feed air to carry out the condensation of step (B);

(F) recovering vapor resulting from the heat exchange of step (E) as product oxygen gas; and (G) passing argon-containing fluid from the second column into an argon column, separating the argon-containing fluid into oxygen-richer liquid and argon-richer vapor, and recovering at least some argon-richer fluid.

2. The method of claim 1 wherein the liquid resulting from the condensation of the feed air is further cooled prior to being introduced into the first column.

3. The method of claim 1 wherein the oxygen-rich liquid is warmed prior to its vaporization against the condensing second portion of the feed air.

4. The method of claim 1 wherein the oxygen-rich liquid is increased in pressure prior to its vaporization against the condensing second portion of the feed air.

5. The method of claim 1 wherein the argon-richer vapor is condensed by indirect heat exchange with oxygen-enriched fluid and resulting argon-richer liquid is recovered as the argon-richer fluid.

6. The method of claim 5 wherein the argon-richer liquid is vaporized by indirect heat exchange with a third portion of the cooled, compressed feed air and the resulting condensed third portion is passed into the first column.

7. The method of claim 1 wherein the second portion of the feed air is partially condensed, the resulting vapor is subsequently condensed and is then introduced into the first column.

8. The method of claim 1 further comprising recovering liquid product from the air separation plant.

9. The method of claim 8 wherein said liquid product is nitrogen-rich fluid.

10. The method of claim 8 wherein said liquid product is oxygen-rich liquid.

11. The method of claim 1 further comprising recovering nitrogen-rich vapor as product nitrogen gas.

12. Apparatus for the separation of air by cryogenic distillation to produce product gas comprising:

(A) an air separation plant comprising a first column, a second column, a reboiler, means to pass fluid from the first column to the reboiler and means to pass fluid from the reboiler to the second column;

(B) a turboexpander, means to provide feed air to the turboexpander and means to pass fluid from the turboexpander into the first column;

(C) a condenser, means to provide feed air to the condenser and means to pass fluid from the condenser into the first column;

(D) means to pass fluid from the air separation plant to the condenser;

(E) means to recover product gas from the condenser; and (F) an argon column, means to pass fluid from the second column to the argon column, and means to recover fluid from the argon column.

13. The apparatus of claim 12 further comprising means to increase the pressure of the fluid passed from the air separation plant to the condenser.

14. The apparatus of claim 12 further comprising means to increase the temperature of the fluid passed from the air separation plant to the condenser.

15. The apparatus of claim 12 further comprising an argon column condenser, means to provide vapor from the argon column to the argon column condenser, means to pass liquid from the argon column condenser to a heat exchanger, means to provide feed air to the said heat exchanger and from the said heat exchanger into the first column.

16. The apparatus of claim 12 wherein the first column contains vapor-liquid contacting elements comprising structured packing.

17. The apparatus of claim 12 wherein the second column contains vapor-liquid contacting elements comprising structured packing.

18. The apparatus of claim 12 wherein the argon column contains vapor liquid contacting elements comprising structured packing.

* * * * *